US006375602B1

(12) United States Patent
Jones

(10) Patent No.: US 6,375,602 B1
(45) Date of Patent: Apr. 23, 2002

(54) SUPERCALENDAR ROLL WITH COMPOSITE COVER

(75) Inventor: Lisa Jones, Toms Brook, VA (US)

(73) Assignee: SW Paper Inc., Southborough, MA (US)

( * ) Notice: Subject to any disclaimer, the term of this patent is extended or adjusted under 35 U.S.C. 154(b) by 0 days.

(21) Appl. No.: 09/121,779

(22) Filed: Jul. 23, 1998

(51) Int. Cl.[7] ..... B25F 5/02

(52) U.S. Cl. ..... 492/50; 492/51; 492/52; 492/56

(58) Field of Search ..... 492/56, 51, 47, 492/48, 49, 17, 50, 52; 29/895, 895.21, 895.211, 895.212, 895.3

(56) References Cited

U.S. PATENT DOCUMENTS

| | | | | |
|---|---|---|---|---|
| 112,988 | A | 3/1871 | Towers | |
| 1,456,458 | A | 5/1923 | Nordell | |
| 2,178,421 | A | 10/1939 | Freedlander | 91/67.8 |
| 2,997,406 | A | 8/1961 | Freeman et al. | 117/64 |
| 3,571,878 | A | 3/1971 | Alderfer | 29/132 |
| 3,622,412 | A | 11/1971 | Ross | 156/87 |
| 3,673,025 | A | 6/1972 | Fukuyama et al. | 156/154 |
| 3,711,913 | A | 1/1973 | Galeone et al. | 29/148.4 D |
| 3,730,794 | A | 5/1973 | Ross | 156/112 |
| 3,852,862 | A | 12/1974 | Sukenik | 29/132 |
| 4,007,680 | A | 2/1977 | Pfleger et al. | 101/153 |
| 4,283,821 | A | 8/1981 | Paakkunainen | 29/129 |
| 4,368,568 | A | 1/1983 | Watanabe | 29/130 |
| 4,475,275 | A | 10/1984 | Edwards | 29/110 |
| 4,705,711 | A | 11/1987 | Perna | 428/141 |
| 5,091,027 | A | 2/1992 | Watanabe | 156/172 |

FOREIGN PATENT DOCUMENTS

| | | | |
|---|---|---|---|
| EP | 0 735 287 A1 | 10/1996 | F16C/13/00 |
| JP | 2-41487 | 9/1990 | D21F/3/08 |

*Primary Examiner*—I Cuda-Rosenbaum
(74) *Attorney, Agent, or Firm*—Myers Bigel Sibley & Sajovec

(57) ABSTRACT

The bone-hard supercalender roll of the present invention comprises: an elongate shaft having a longitudinal axis; a core layer formed of fibrous material circumferentially covering the shaft; means for compressing the core layer along the shaft longitudinal axis; an intermediate layer circumferentially covering the core layer that comprises a first polymeric resin and a heavy textile material; and an outer layer circumferentially covering the intermediate layer that comprises a second polymeric resin and a reinforcing material. In this configuration, the roll can provide the requisite bone-hard surface for calendering applications, but can do so without the surface denting and marring problems associated with filled rolls and the expense of rolls formed of covered metal cores.

34 Claims, 4 Drawing Sheets

SUPERCALENDAR ROLL WITH COMPOSITE COVER

FIELD OF THE INVENTION

The present invention relates generally to industrial rolls, and more particularly to supercalender rolls having bone-hard surfaces.

BACKGROUND OF THE INVENTION

Calendering is the process of passing a sheet material through rolls or plates to impart a smooth, glossy appearance to the sheet material. This process can be enhanced through a "supercalendering" process, in which the sheet material is exposed to heat in addition to the pressure applied by the rolls or plates. Supercalendering is particularly prevalent in the production of SC grade paper (such as that typically used for printing and writing) that often requires a smooth, high density, glossy surface and a uniform caliper.

Because of the demands of the supercalendering process, a supercalender roll should have a "bone-hard" calendering surface. The term "bone-hard" is generally understood to mean that the surface has an elastic modulus of at least 200,000 psi and a Shore D hardness rating of at least 80. Of course, a supercalender roll should also be constructed of materials that enable it to withstand the extreme pressure, heat and moisture encountered in the supercalendering process.

One type of supercalender roll that has been used historically is the so-called "filled roll," which is formed of very tightly pressed paper, cotton, or similar natural or synthetic fiber material (such as Kevlar®, Nomex® or rayon). In some embodiments, annular disks of the fibrous material are stacked on a central shaft and pressed together very tightly by pressure plates located on the ends of the shaft. These disks typically form a layer that extends radially outwardly from the shaft between about 5 and 10 inches. The pressure applied to the disks by the pressure plates is generally sufficient to render the surface of the fibrous material "bone-hard." Exemplary filled rolls are described in U.S. Pat. No. 4,283,821 to Paakkunainen and U.S. Pat. No. 4,475,275 to Edwards.

A filled roll can provide a very light, strong and hard roll, but one that is quite prone to dents or marks on its surface. Of course, such dents or marks can adversely impact the surface of the roll, which may render it unsuitable for a process where surface consistency is important, such as papermaking. One attempt to address this shortcoming involves the inclusion of a polymer cover over a filled roll; one example of this construction is described in U.S. Pat. No. 3,711,913 to Galeone et al. However, many filled rolls having polymer covers have proven unsuitable in that bonding between the cover and the fibrous portion of the roll can be inconsistent, resulting in delamination of the cover. Also, typically the cover is unable to prevent the fibrous portion of the roll from denting under impact. When this occurs, the dented fibrous portion can separate from the cover such that the localized dented areas no longer directly support the cover. As a result, the unsupported areas of the cover can fatigue and ultimately fail under load.

As an alternative, some bone hard supercalender rolls are constructed of an epoxy matrix reinforced with glass fiber and other filler materials, such as organic, carbon or other ceramic fibers. The epoxy matrix is typically applied as a layer approximately 0.4–1.5 inches in thickness over a hollow metal core. Although such epoxy-coated rolls are generally more durable and consistent in operation than are filled rolls, this variety of supercalender roll can be quite expensive to a paper producer because of the costs to purchase all new metal cores.

SUMMARY OF THE INVENTION

In view of the foregoing, it is an object of the present invention to provide a supercalender roll with a durable supercalendering surface that is not prone to dents, nicks, and other surface imperfections.

It is also an object of the present invention to provide a cost-effective supercalender roll with such a surface.

It is another object of the present invention to provide such a supercalender roll that capitalizes on the cost and weight advantages of filled supercalender rolls.

These and other objects of the present invention are satisfied by the present invention, which is directed to a bone-hard supercalender roll with a polymeric cover. In one embodiment, the bone-hard supercalender roll of the present invention comprises: an elongate shaft having a longitudinal axis; a core layer formed of fibrous material circumferentially covering the shaft; means for compressing the core layer along the shaft longitudinal axis; an intermediate layer circumferentially covering the core layer that comprises a first polymeric resin and a heavy textile material; and an outer layer circumferentially covering the intermediate layer that comprises a second polymeric resin and a reinforcing material. In this configuration, the roll can provide the requisite bone-hard surface for calendering applications, but can do so without the surface denting and marring problems associated with filled rolls and the expense of rolls formed of covered metal cores.

In another embodiment, the present invention is directed to a bone-hard supercalender roll comprising: an elongate shaft; an intermediate layer circumferentially covering the shaft that comprises a first polymeric resin and a heavy textile material; and an outer layer circumferentially covering the intermediate layer that comprises a second polymeric resin and a reinforcing material. In this embodiment, there is no hollow metal core (as has been the case for many prior art rolls with polymeric covers) nor its associated expense, and the intermediate layer and outer cover provide the requisite bone-hard surface for calendering.

In each of these embodiments, the inclusion of the heavy textile fiber material can occupy volume within the roll and provide structural integrity thereto without the expense of a metal core or the denting and marring problems associated with filled rolls. The heavy textile material has proven to provide a sound bonding substrate for the outer cover, and it can also bond effectively to the fibrous material of a core layer. It is preferred that the heavy textile material be a coarse fiberglass fabric; more preferably, the fabric has a mock leno weave, which provides a relatively high effective thickness to the fabric, particularly for multiple overlying plies, and also provides roughness to the fabric to improve interlaminar bonding and shear strength.

DETAILED DESCRIPTION OF THE INVENTION

Figures 1, 2, 3A:
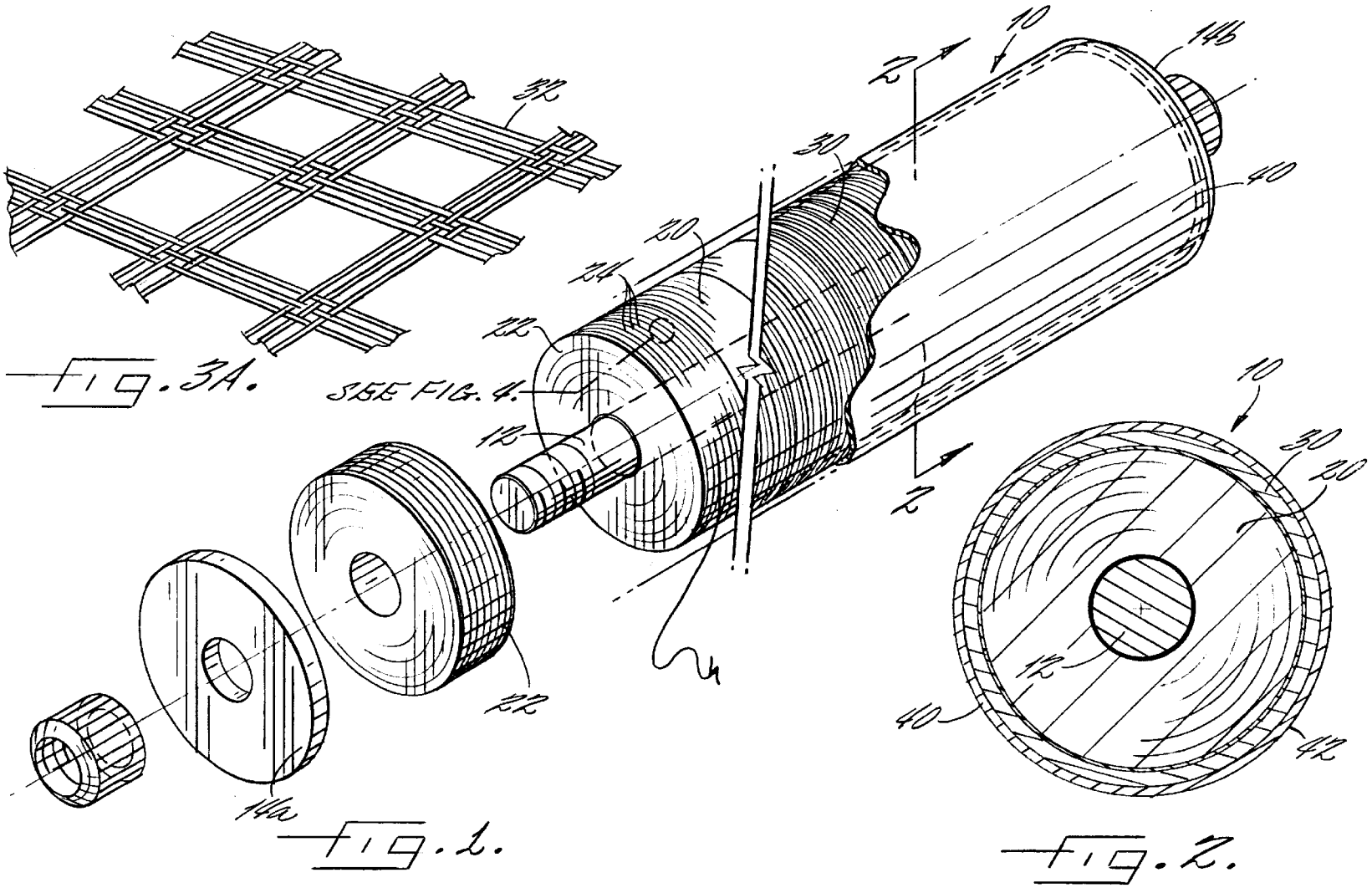
FIG. 1 is an exploded, cut away perspective view of a supercalendar roll of the present invention.
FIG. 2 is a section view of the roll of FIG. 1 taken along lines 2—2 therein.
FIG. 3A is a greatly enlarged perspective view of fibers of the mock leno fabric included in the intermediate layer of the roll of FIG. 1.

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

Referring now to the drawings, a supercalender roll, designated broadly at 10, is illustrated in FIGS. 1 through 7. The roll 10 includes an elongate cylindrical shaft 12, a pair of pressure plates 14*a,* 14*b* attached at either end of the shaft 12, a core layer 20, a intermediate layer 30, and an outer cover 40. The roll 10 is configured to be mounted in an apparatus, such as a papermaking machine, that calenders a sheet material.

The shaft 12 is of a configuration known to those skilled in this art; i.e., it is elongate and generally cylindrical and is constructed for mounting to a calendering apparatus for rotation about its longitudinal axis. The shaft 12 typically includes threads, keys, or the like at each end (not shown) that enable the pressure plates 14*a,* 14*b* or other means for compressing the core layer 20 to be mounted thereon.

Figures 3, 4, 5:
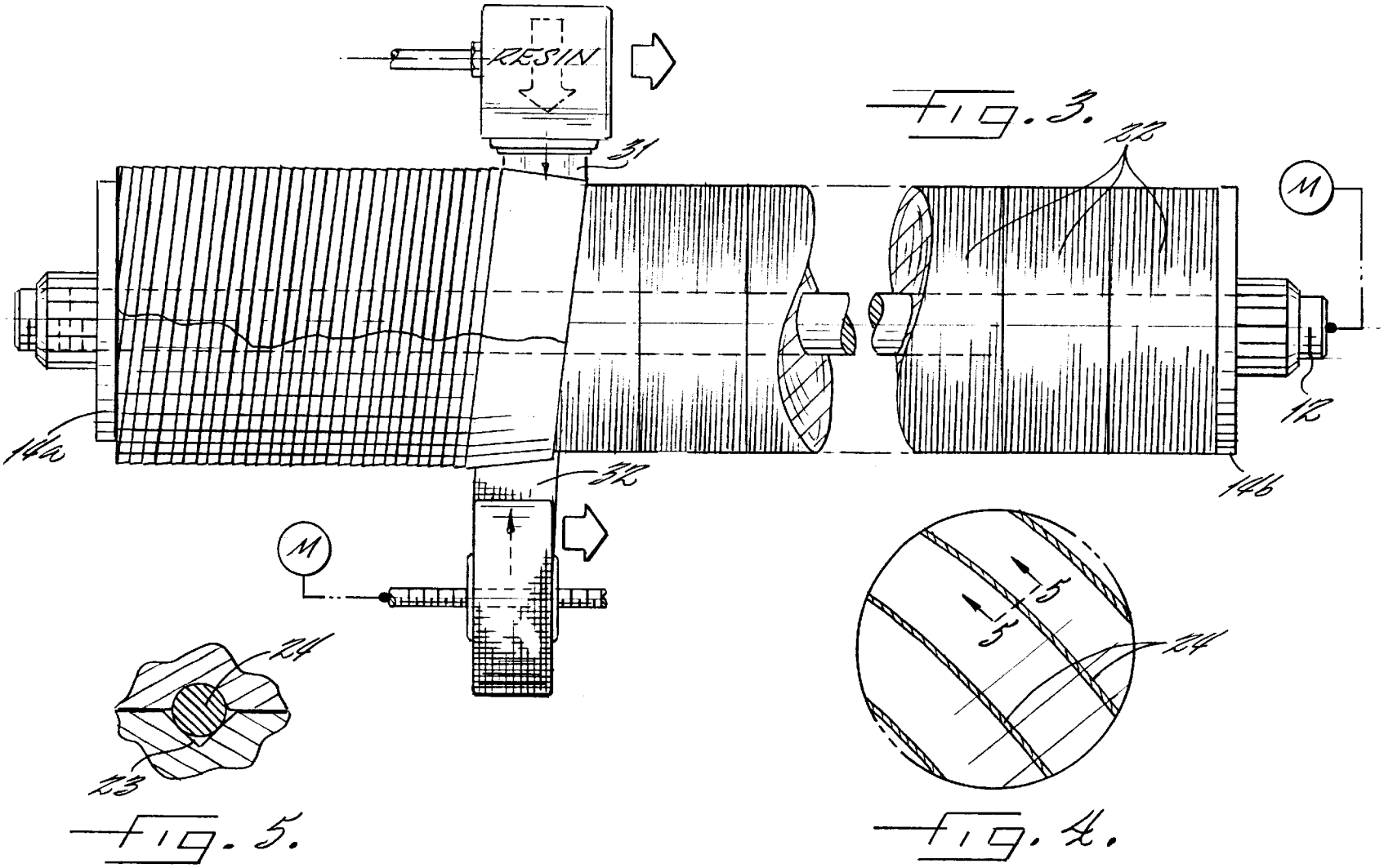
FIG. 3 is an end view of the core and intermediate layers of the roll of FIG. 1, with the intermediate layer being applied over the core layer.
FIG. 4 is a greatly enlarged perspective view of glass roving strands wrapped over the core layer of the roll of FIG. 1.
FIG. 5 is a greatly enlarged section view of the glass roving strand taken along lines 5—5 of FIG. 4.
Figure 6:
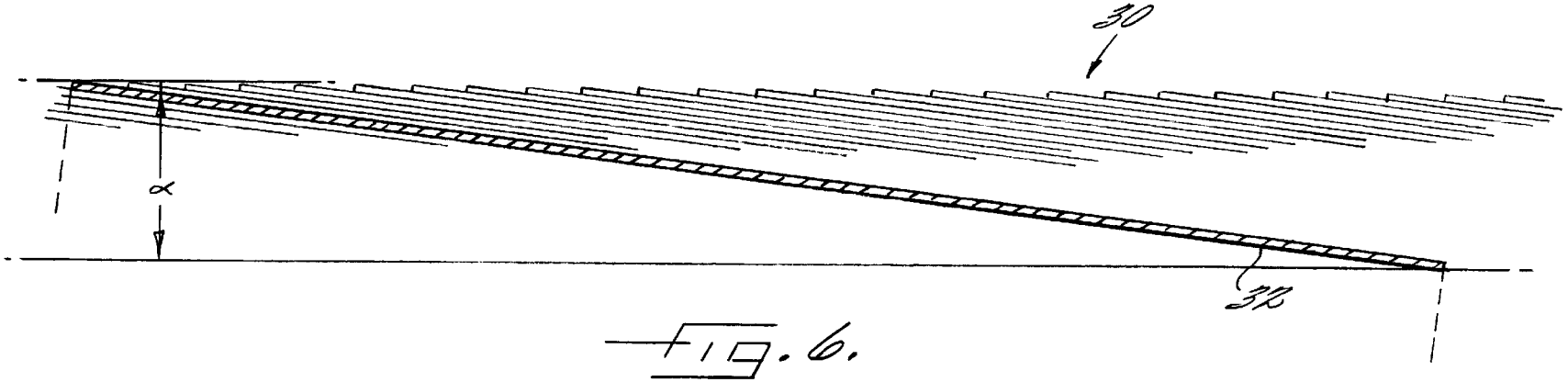
FIG. 6 is a greatly enlarged section view of portions of the core and intermediate layers of the roll of FIG. 1.

Referring to FIGS. 1 through 3, the core layer 20 comprises a fibrous material, such as that typically included in a conventional filled roll, that circumferentially covers the shaft 12. As used herein, that one layer "circumferentially covers" another means that the overlying layer covers substantially all of the exterior cylindrical surface of the underlying layer. It is intended that this term include configurations in which the overlying layer covers a large majority of the underlying component or layer, such as is the case when the core layer 20 covers most of the span of the shaft 12, but the ends of the shaft 12 remain uncovered by the core layer 20 so that the pressure plates 14*a,* 14*b* can be mounted thereon and the shaft 12 can be mounted within a calendering apparatus.

The fibrous material of the core layer 20 takes a generally cylindrical shape; illustratively (FIGS. 1 and 3), the fibrous material is a plurality of annular disks 22 that are stacked upon one another along the length of the shaft 12 to form a cylinder. The fibrous material typically extends radially from the shaft 12 between about 4 and 9 inches. Preferably, the fibrous material is compressed between the pressure plates 14*a,* 14*b* (typically to a pressure of between about 8 and 12 ksi); this pressure can be applied by a threaded joint between the pressure plates 14*a,* 14*b* and the shaft 12. Such pressure should cause the fibrous material to have a Shore D surface hardness of at least 80. Exemplary fibrous materials for the core layer 20 include natural fibrous materials such as paper or cotton and synthetic fibrous materials such as Kevlar® and Nomex® aramid fibers and rayon cellulosic fiber. It is contemplated that, in the manufacture of the roll 10, the core layer 20 can be newly constructed or can be a used, refurbished filled roll.

Once the fibrous material of the core 20 has been mounted on the shaft 12, the fibrous material may be treated prior to the application of the intermediate layer 30. For example, the fibrous material may be ground to a desired diameter and/or surface smoothness. Also, grooves 23 may be formed in the surface of the fibrous material to provide texture suitable for mechanical bonding of the intermediate layer (see FIGS. 4 and 5). Such grooves may be filled with strands of glass roving (designated at 24) or other fiber that enhancing interlaminar bonding. Also, the fibrous material may be heated (for example, for about 20 to 30 hours) prior to the application of the intermediate layer 30 in order to facilitate application of the intermediate layer 30.

Referring again to FIGS. 1 through 3, the intermediate layer 30 circumferentially surrounds the core layer 20. The intermediate layer 30 comprises a first polymeric resin (designated herein at 31) and a heavy textile material 32.

The first polymeric resin 31 can be any polymeric resin known to those skilled in this art to be suitable for use in the given calendering application; i.e., the resin should have sufficient strength, rigidity, fatigue resistance, and thermal stability to withstand the calendering conditions. Exemplary materials include epoxy, bis-malimide, vinyl ester, polyamide, polyetherimide, phenolic, polysulfone, polyetheretherketone, polyethersulfone, malimide, polyetherketone, cyanate ester, and blends and copolymers thereof. Epoxy resins and blends and copolymers thereof are preferred for supercalendering rolls, particularly those used in papermaking operations. An exemplary epoxy resin is DER331, available from Dow Chemicals, Midland, Mich.

The first polymeric resin 31 can be unfilled (i e "neat") or can include one or more fillers. Fillers are typically added to modify the physical properties of the resin and/or to reduce its cost. Exemplary filler materials include glass, inorganic oxides such as aluminum oxide ($Al_2O_3$), silicon dioxide ($SiO_2$), calcium oxide (CaO), silicates such as clays, talc, wollastonite ($CaSiO_3$), and feldspar ($KAlSi_3O_8$), metallic powders such as aluminum, iron, copper, stainless steel, or nickel, calcium carbonate ($CaCo_3$), and nitrides and carbides, such as silicon carbide (SiC) and aluminum nitride (AlN). These fillers may be in virtually any form, such as powder, pellet, fiber, sphere or bead. When an epoxy resin is employed, it is preferred that glass filler also be included. Also, the polymeric resin 31 may include other additives, such as polymerization initiators, curing agents, plasticizers, pigments and the like, that can facilitate processing and enhance physical properties.

The heavy textile material 32 of the intermediate layer 30 reinforces the first polymeric resin material 31, thereby providing strength and rigidity. As used herein, a "heavy textile material" is a continuous material that is relatively thick (i.e., has a relatively high caliper). The material may be of a single continuous fiber reinforcement (single or multifilament, such a braid or twist) or a plurality of fibers or yams in a continuous two dimensional form, such as a course fabric, sheet, tape, or strip. Exemplary heavy textile materials may include forms of fiberglass, carbon fiber, aramid fiber, metallic fiber, and ceramic fiber. The heavy textile material should have sufficient thickness that, when wrapped in overlying plies or layers, the thickness increases relatively rapidly (for two-dimensional forms such as fabrics and strips, these are sometimes known in the art as "2½-D" materials for their thickness and reinforcing ability). Because of their yarn thickness and/or construction, the heavy textile material 32 can occupy greater space in fewer overlying layers than a finer material, thereby requiring fewer layers or plies of fiber to a given thickness. The heavy textile material should be at least 0.010 inches in thickness, and is preferably at least 0.050 inches in thickness.

It is preferred that a woven fiberglass fabric be employed as the heavy textile material. 32. Fabric weaves such as leno and mock leno weaves (a mock leno weave is illustrated in FIG. 3A), in which the fibers making up the fabric exhibit relatively little surface coplanarity, are particularly suitable for use as the heavy textile material. Such fabrics not only occupy significant volume, particularly in overlying plies, but also have a rough texture that provides a mechanical "interlocking" in overlying plies that can increase bonding strength and overall structural integrity of the intermediate layer 30.

As an example, a heavy woven mock leno fiberglass fabric having a weight of over 5 ounces per square yard (opsy) (as opposed to the more conventional 1 to 2 opsy fabrics often employed in other roll covers) may be used, with fabrics having weights of greater than 10 or even 15 opsy being preferred. Such fabrics generally have thicknesses of between about 0.010 and 0.050 inches per ply. Thus, if the thickness of the intermediate layer 30 is 1.5 inches (between about 1.5 and 4 inches is preferred), this thickness can be achieved with a 20 opsy mock leno fabric of 0.030 inch thickness with only 48 overlying plies, rather than the 200 plies typically required by a finer fiberglass fabric, and significant mechanical interlocking of plies is achieved. It is also preferred that the fabric be wrapped with a high percentage (80+) overlap (such as are illustrated in FIG. 3), as the effective thickness effects of the fabric can cause the angle between the plane of the fabric and the longitudinal axis of the shaft 12 to be as great as 5 to 10 degrees and thereby occupy significant volume and provide greater radial reinforcement.

It is contemplated that the heavy textile material 32 may include more than one component. For example, carbon fiber may be woven into a fiberglass fabric, braid or multifilament fiber to impact the electrical properties of the roll 10. Similarly, metal fiber may be woven into a fiberglass fabric, braid or multifilament fiber to raise the thermal conductivity of the roll 10.

The intermediate layer 30 can be applied over the core layer 20 by any technique known to those skilled in this art to be suitable for the application of reinforced polymeric resins over an established core. These techniques include drip impregnation, bath impregration, resin transfer molding, and preimpregration processes. For the illustrated fiberglass fabric, it is preferred that the fabric be wrapped in overlapping, overlying plies as the resin material 31 flows or drips uniformly onto the roll through a flow nozzle to impregnate the fabric (see FIGS. 3 and 6). In some instances, it is preferred that the roll be heated after application of the resin and heavy textile material to allow the resin to gel.

Figure 7:
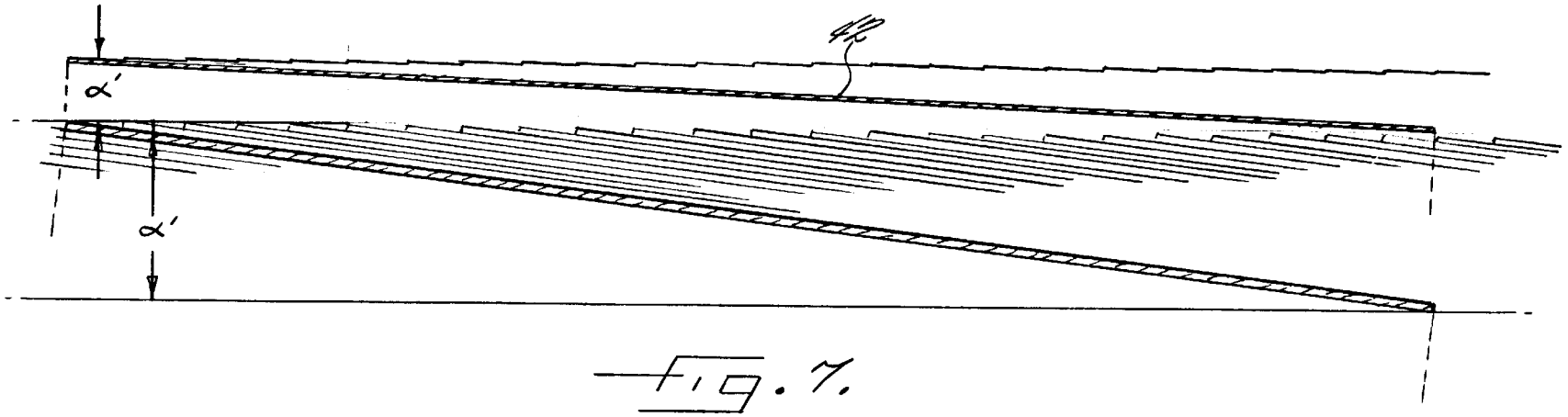
FIG. 7 is a greatly enlarged section view of the core and intermediate layers in the outer cover of the roll of FIG. 1.

Referring to FIGS. 1, 2 and 7, the outer cover 40, which circumferentially overlies the intermediate layer 30, comprises a second polymeric resin 41 and a reinforcing material 42. The outer cover 40 serves as the contact surface for the roll 10 as it contacts sheet material during processing.

The second polymeric resin 41 can be any polymeric resin recognized by those skilled in this art to be suitable for contacting a sheet material during processing and providing the desired function. It may be the same as or different from the first polymeric resin, although it is preferred that the second resin material be the same as the first resin material for interlaminar bonding compatibility. Exemplary polymeric resins for the outer cover 40 include epoxy, bismalimide, malimide, vinyl ester, polyurethane, polyamide, polyetherimide, phenolic, polysulfone, polyetheretherketone, polyethersulfone, polyetherketone, cyatate ester, and blends and copolymers thereof. Of these, epoxy and polyurethane resins are preferred for use in supercalendering operations, with epoxy resins being more preferred. As is the case with the first resin 31, the second resin 41 may include a filler material, although a neat resin material is preferred, and also may include other, components, such as pigments, plasticizers, polymerization initiators, curing agents, and the like.

The reinforcing material 42 can be any known by those skilled in this art to provide the desired surface characteristics for the processing of sheet material. Exemplary reinforcing materials include glass, other inorganic materials, carbon fiber, aramid fiber, and the like. These can be included in many forms, such as woven and nonwoven fabrics, fibers, beads, spheres and powders. Of these, a combination of multiple layers of woven and non-woven fiberglass fabrics and a nonwoven aramid fabric is preferred, particularly with an outer layer of a nonwoven fabric (see FIG. 7).

The outer cover 40 can be applied over the intermediate layer 30 by any of a number of known techniques for resin application and will depend on the resin and reinforcing material selected. Exemplary techniques include casting and drip impregnation, with drip impregnation being preferred. It is also preferred that a base ply of a rough fabric, such as woven fiberglass, be wrapped over the intermediate layer 30 prior to the application of the outer cover 40 in order to improve interlaminar bonding. For supercalendering, the outer cover 40 should have a Shore D hardness of at least 80, and preferably between 85 and 95.

Rolls of this configuration can solve the shortcomings of prior art supercalendering rolls. Rolls of the present invention have proven to be quite suitable for supercalendering operations, as the surface of the outer layer 40 is quite similar to that of a prior art bone-hard supercalendering roll comprising a polymer cover applied over a metal core. However, the roll of the present invention is much less expensive to produce, as the core layer 20 of fibrous material is considerably less expensive than a metal core. Comparing the roll of the present invention to traditional filled rolls, the rolls of the present invention can be produced relatively inexpensively (like filled rolls), and can be re-worked easily, yet they do not suffer the same tendency to mark and dent as traditional filled rolls. The ability of the intermediate layer 30 to occupy significant volume between the fibrous core of the roll and the outer cover, to protect the fibrous core from marks and dents, to provide a compatible and mechanically sound bonding site for the outer cover, but to do so at a relatively low cost because of the effective thickness of the heavy textile material, can make the rolls of the present invention an excellent cost-effective solution to the problems with prior supercalendering rolls.

Figure 8:
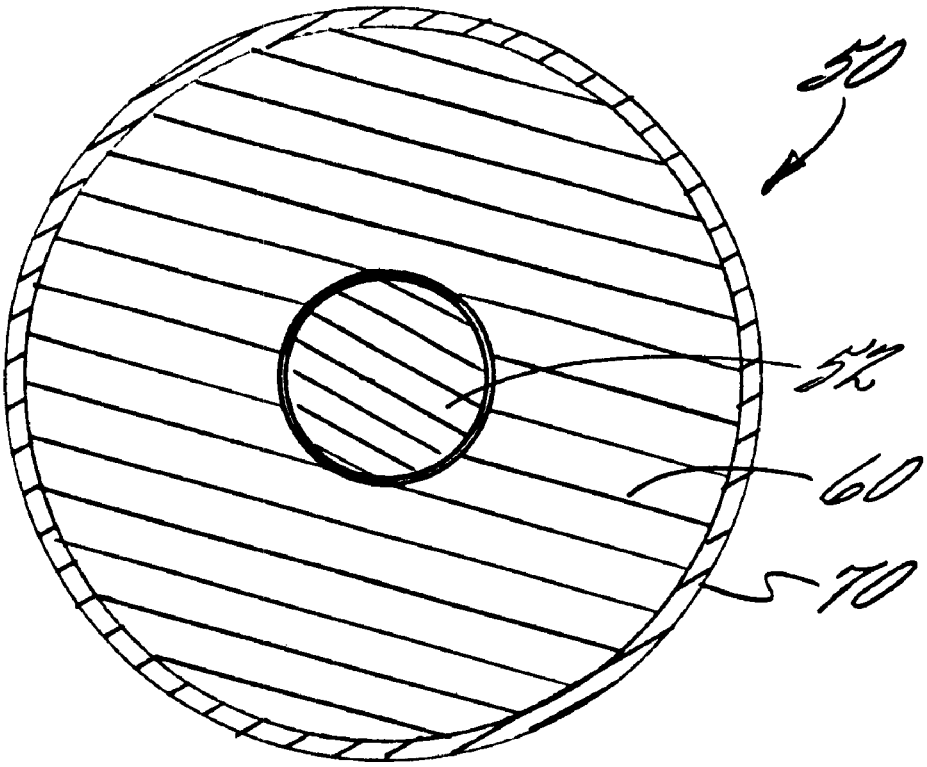
FIG. 8 is a section view of another embodiment of the supercalendar roll of the present invention.

A second embodiment of a roll of the present invention, designated broadly at 50, is illustrated in FIG. 8. The roll 50 includes a metal shaft 52 at its center, an intermediate layer 60, and an outer layer 70. Its construction is like that of the roll 10 described above, but with the fibrous material core omitted. The shaft 52 is formed of metal (preferably steel), and is of conventional configuration as described above for the shaft 12, although pressure plates are omitted because of the absence of a fibrous material core. The intermediate layer 60 includes a first reinforcing resin and a heavy textile material. Each of these constituents can be formed with the materials and techniques described hereinabove for the intermediate layer 20 of the roll 10, although in the roll 50, the intermediate layer 60 is between about 3 and 9 inches. Thus, if the exemplary coarse woven 20 opsy mock leno fiberglass fabric described above is employed as the reinforcing material, such a fabric may be wound in about 100 plies to achieve a 3 inch thickness. The outer layer 70 comprises a second polymeric resin and a second reinforcing material. The discussion above regarding polymeric resins and reinforcing materials for the outer layer 40 of the roll 10 is equally applicable here.

The invention is described in greater detail hereinbelow in the following non-limiting examples.

EXAMPLE 1

Filled Roll with Intermediate Layer and Outer Cover

A. Preparation of the Filled Roll Core

A used filled roll formed of rayon fibers over a metal shaft was obtained. Initially, the filled roll measured approximately 18.265 inches in diameter. The fibrous rayon was ground to generate a fresh surface for bonding. It was first ground with a 60 grit belt to a diameter of about 18.0 inches, then several finishing passes were made with a 120 grit belt. All grinding was performed as the roll was dry.

The roll was then grooved to increase the surface area available for bonding. A Ventanip® wheel (available from Elenco Tool Corp.) was used to create the grooves; the wheel was 0.125 inches wide and produced a 90° cut with a radiused tip. A continuous spiral groove 0.090 inches in depth was formed in the rayon surface of the roll, with six circumferential loops being cut per linear inch of roll. Air was directed in the cutting area to cool the cover and remove dust. The roll was placed in a dry heat oven at 90±5° C. (194±10° F.) to preheat for 20–30 hours.

B. Application of the Intermediate Layer

After being impregnated with epoxy, two glass roving strands about of 1062 style yarn (100,620 yards of roving pound) were wound into the spiral groove in the roll. Once the rovings were in place, a woven mock leno fiberglass fabric impregnated with glass-filled epoxy was wrapped over the rayon core. The epoxy was a blend of 100 parts epoxy resin, 48 parts glass beads, and 27 parts diamine curing agent. The fiberglass fabric was a 20 opsy fabric having a width of 6 inches and a thickness of about 0.030 inches. The fabric was wrapped at about 11 rpm with a 0.25 inch traverse per revolution, such that the 6" wide fabric created 24 overlying plies across the span of the roll. Resin was applied by dripping a steady flow onto the fabric as it was wrapped at a rate of about 2 liters per minute. The fabric remained wet, but resin waste was minimized. The fabric was applied at 55 lbs of tension. After the entire span of the roll was covered with impregnated fabric, a second pass was made with the fabric under the same conditions. The roll was then allowed to gel for 16 hours at 165–175° .F surface temperature. The roll was cooled to room temperature, then was rough ground to a constant diameter of 20.280±0.10 in. A final grinding of the intermediate layer was performed with a 180 grit belt.

C. Application of the Outer Cover

After the intermediate layer was gelled and ground, the outer cover was applied. An epoxy resin blend of 100 parts epoxy (DER 331) and 18 parts diamine curative was applied over the intermediate layer at a rate of 0.85 to 1 liter/minute. Subsequent epoxy layers were then added with reinforcing materials as set forth in Table 1.

TABLE 1

| |
|---|
| 3 passes woven fiberglass fabric (5 opsy) |
| 1 pass nonwoven fiberglass fabric (1 opsy) |
| 2 passes woven fiberglass fabric (5 opsy) |

A spun lace Kevlar® fabric was then applied with an epoxy blend of 100 parts epoxy and 32.6 parts diamine curative at a rate of 1.4 liters per minute.

After application of the outer cover, the roll was then allowed to gel for 2 hours at 140° .F and 6 hours at 158° F. Finally, the roll was cut to length; cured as indicated in Table 2, and the radius was ground to a 10 $\mu$in Ra finish.

TABLE 2

| | |
|---|---|
| 176° F. | 12 hours |
| 194 | 12 |
| 212 | 12 |
| 230 | 24 |

The total thickness of the outer cover was 0.3 inches.

EXAMPLE 2

Roll with Intermediate Layer and Outer Cover over Steel Core

A steel shaft with a diameter of 17 inches was sandblasted for texturing. A mock leno fabric impregnated with an epoxy resin reinforced with glass beads was then applied in the manner described in Section B of Example 1 hereinabove to form an intermediate layer. One hundred plies of the fabric were applied until the intermediate layer was 3 inches in thickness. Because of this thickness, the intermediate layer was oven cured at 230° F. for 24 hours. The outer cover was then applied as described in Section C of Example 1.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein. In the claims, means-plus-function clauses are intended to cover the structures described herein as performing the recited function and not only structural equivalents but also equivalent structures.

That which is claimed is:

1. A bone-hard supercalender roll, comprising:

an elongate shaft having a longitudinal axis;

a core layer formed of fibrous material circumferentially covering said shaft;

means for compressing said core layer along said shaft longitudinal axis;

an intermediate layer circumferentially covering said core layer, said intermediate layer comprising a first polymeric resin and a heavy textile material; and an outer layer circumferentailly covering said intermediate layer, said outer layer comprising a second polymeric resin and a reinforcing material.

2. The supercalender roll defined in claim 1, wherein said heavy textile material comprises a coarse fiberglass fabric.

3. The supercalender roll defined in claim 2, wherein said coarse fiberglass fabric has a density of between about 15 and 25 ounces per square yard.

4. The supercalender roll defined in claim 2, wherein said coarse fiberglass fabric is a woven fabric having a mock leno weave.

5. The supercalender roll defined in claim 1, wherein said first polymeric resin is an epoxy resin.

6. The supercalender roll defined in claim 5, wherein said first polymeric resin includes a glass filler.

7. The supercalender roll defined in claim 1, wherein said fibrous material of said core layer is selected from the group consisting of: paper, cotton, rayon, and aramid.

8. The supercalender roll defined in claim 1, wherein said second polymeric resin comprises an epoxy resin.

9. The supercalender roll defined in claim 2, wherein said coarse fiberglass fabric is disposed in multiple overlying plies.

10. The supercalender roll defined in claim 1, wherein said second reinforcing material is selected from the group consisting of: woven and nonwoven fiberglass fabric and nonwoven aramid fabric.

11. The supercalender roll defined in claim 10, wherein said second reinforcing material is disposed in multiple overlying plies.

12. The supercalender roll defined in claim 1, wherein said outer layer has a Shore D surface hardness of between about 85 and 95.

13. The supercalender roll defined in claim 1, wherein said means for compressing said core layer comprises a pair of plates attached at each end of said shaft.

14. A bone-hard supercalender roll, comprising:

an elongate shaft;

an intermediate layer circumferentially covering said shaft, said intermediate layer comprising a first polymeric resin and a heavy textile material; and an outer layer circumferentially covering said intermediate layer, said outer layer comprising a second polymeric resin and a reinforcing material.

15. The supercalender roll defined in claim 14, wherein said heavy textile material comprises a coarse fiberglass fabric.

16. The supercalender roll defined in claim 15, wherein said coarse fiberglass fabric has a density of between about 15 and 25 ounces per square yard.

17. The supercalender roll defined in claim 15, wherein said coarse fiberglass fabric is a woven fabric having a mock leno weave.

18. The supercalender roll defined in claim 14, wherein said first polymeric resin is an epoxy resin.

19. The supercalender roll defined in claim 14, wherein said second polymeric resin comprises an epoxy resin.

20. The supercalender roll defined in claim 14, wherein said intermediate layer extends radially away from said core layer between about 1.5 and 4 inches.

21. The supercalender roll defined in claim 14, wherein said second reinforcing material is selected from the group consisting of: woven and nonwoven fiberglass fabric and aramid fabric.

22. The supercalender roll defined in claim 14, wherein said outer layer has a Shore D surface hardness of between about 85 and 95.

23. A method of manufacturing a bone-hard supercalender roll, comprising:

providing a compressed fibrous core layer circumferentially covering an elongate shaft;

applying an intermediate layer to circumferentially cover said core layer, said intermediate layer comprising a first polymeric resin and a heavy textile material; and applying an outer cover to circumferentially cover said intermediate layer, said outer cover comprising a second polymeric resin and a reinforcing material.

24. The method defined in claim 23, wherein said heavy textile material comprises a coarse fiberglass fabric.

25. The method defined in claim 24, wherein said coarse fiberglass fabric has a density of between about 15 and 25 ounces per square yard.

26. The method defined in claim 24, wherein said coarse fiberglass fabric is a woven fabric having a mock leno weave.

27. The method defined in claim 23, wherein said first polymeric resin is an epoxy resin.

28. The method defined in claim 27, wherein said first polymeric resin includes a glass filler.

29. The method defined in claim 23, wherein said fibrous material of said core layer is selected from the group consisting of: paper, cotton, rayon, and aramid.

30. The method defined in claim 23, wherein said second polymeric resin comprises an epoxy resin.

31. The method defined in claim 24, wherein said coarse fiberglass fabric is applied in multiple overlying plies.

32. The method defined in claim 23, wherein said second reinforcing material is selected from the group consisting of: woven and nonwoven fiberglass fabric and nonwoven aramid fabric.

33. The method defined in claim 23, wherein said second reinforcing material is applied in multiple overlying plies.

34. The method defined in claim 23, further comprising the step of curing the outer cover to a Shore D surface hardness of between about 85 and 95.

* * * * *